United States Patent [19]

Lehman, Jr. et al.

[11] Patent Number: 4,497,492

[45] Date of Patent: Feb. 5, 1985

[54] GAME WITH SHIELDS FOR DEFLECTING HURLED PROJECTILE

[76] Inventors: R. Danford Lehman, Jr., 6944 Park Ave.; Michael F. Williams, 6903 Park Ave., both of McLean, Va. 22101

[21] Appl. No.: 440,991

[22] Filed: Nov. 12, 1982

[51] Int. Cl.[3] ..... A63B 71/00

[52] U.S. Cl. ..... 273/411

[58] Field of Search ..... 273/411, 412, 359, 317, 273/67 B, 322; 84/402 A; 89/36 R

[56] References Cited

U.S. PATENT DOCUMENTS

| | | | |
|---|---|---|---|
| 2,930,618 | 3/1960 | Glintz | 273/67 B X |
| 3,024,024 | 3/1962 | Chalcroft | 273/411 |
| 3,378,260 | 4/1968 | Hartel | 273/412 X |
| 3,697,074 | 10/1972 | Duncan | 273/322 |
| 4,083,562 | 4/1978 | Zepper | 273/1 B X |

FOREIGN PATENT DOCUMENTS

| | | | |
|---|---|---|---|
| 9177 | of 1912 | United Kingdom | 273/359 |

*Primary Examiner*—William H. Grieb
*Attorney, Agent, or Firm*—Epstein & Edell

[57] ABSTRACT

A game has as its object the throwing of a projectile, such as a ball, by one player into a target area which is defended by another player. The defender has a shield which is held in one or both hands and used to deflect the projectile in a manner such that the deflected projectile can be caught in the defender's empty hand. The target area may be laid out on the ground, in which case the defender stands within the target area and tries to deflect the projectile and catch it while still in that area. If the defender catches the projectile while still in the defended target area, the defender may throw the projectile at the opponent's target area from the point of the catch; otherwise, throws are made from behind the defended goal. The shield is provided with a concave deflecting surface and a handle which permits the shield to be held in one hand so as to direct the deflecting surface away from the defender. In the preferred embodiment, the target area is laid out on the ground in the form of isosceles trapezoids having their short sides serving as the forwardmost target area portion and the respective parallel long sides serving as a base line behind which throws are made unless the projectile is caught within the target area.

19 Claims, 8 Drawing Figures

GAME WITH SHIELDS FOR DEFLECTING HURLED PROJECTILE

BACKGROUND OF THE INVENTION

1. Technical Field

The present invention relates to games involving a hurled projectile and, more particularly, to a new game played by at least two players in which each player defends a target area by attempting to prevent the other player from hurling the projectile into the defended area.

2. Prior Art

There are numerous games in which players attempt to score points by hurling a projectile, such as a ball, into a target area defended by other players. Examples of such games are hockey, soccer, basketball, etc., which are primarily team sports and require relatively large playing areas and/or expensive equipment. Other prior art games permit individual players to compete by hurling projectiles or objects into undefended target areas. Examples of the latter type of game are Ring Toss, Horse Shoes, Bean Bag, etc., wherein a relatively narrow range of skills and coordination is required to play. Specifically, each player need only aim the projectile toward the goal, requiring only the eye and hand coordination which is consistent with throwing the projectile into the goal.

OBJECTS AND SUMMARY OF THE INVENTION

It is an object of the present invention to provide a game and game apparatus which can be played in a relatively small area with only two people and requires a variety of skills and coordination to play.

It is another object of the present invention to provide a game of the type wherein a projectile must be hurled into a target area and which can be played by two people, but wherein additional skills are required in defending against the projectile reaching the defender's target area.

Still another object of the present invention is to provide a game in which a player, in order to successfully play, must have the skill and coordination necessary to hurl a projectile into a target area as well as the skill and coordination necessary to defend his or her target area by deflecting the hurled projectile with a shield so as to be able to catch the deflected projectile within a limited area.

It is yet another object of the present invention to provide a shield suitable for use in a game of the type described, which shield permits a defending player to deflect a hurled projectile with the shield held in one hand, with the possibility of guiding or supporting the shield with the other hand, so as to permit the deflected projectile to be caught with said other hand.

In accordance with the present invention, a game for two or more players uses a projectile, such as a tennis ball, and a shield for each player. The object of the game is to throw the projectile into a target area defended by another player. The defender must deflect the projectile with the shield so that the defender can catch the deflected projectile in his/her hand. Scoring rules can vary as desired; generally, however, the thrower scores points by throwing the projectile into the target area defended by the other player, and the defender scores points by deflecting and catching the projectile. In one embodiment the target areas are spaced triangular or trapezoidal areas laid out on the ground and in which the defender stands. If the defender deflects and catches the projectile while within the defended target area, he or she may throw the projectile at the target area defended by the other player from the location at which the projectile was caught. Otherwise, the projectile must be thrown from behind the goal defended by the thrower.

The horizontal target area may have any shape which is consistent with the degree of scoring and defending difficulty intended. Alternatively, the target area may be vertically oriented, much like a soccer goal, in which case the defender stands in a prescribed area in front of the goal and must deflect and catch the projectile within that area.

The shield has a concave deflecting surface and a handle which permits the defender to hold the shield in one hand and guide it with the other hand with the deflecting surface facing away from the defender. The handle is located to permit manipulation of the shield by the defender so that, with practice, the defender may deflect the projectile in a manner which facilitates catching the deflected projectile.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF THE PREFERRED EMBODIMENTS

Figure 1:
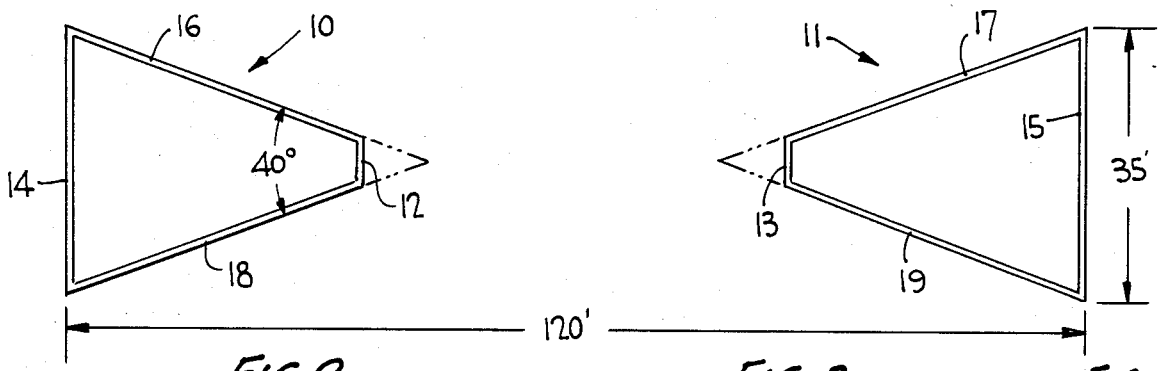
FIG. 1 is a diagramatic view in plan of a typical playing area layout for the game of the present invention.

Referring specifically to FIG. 1 of the accompanying drawing, an embodiment of the game of the present invention has a playing area layout wherein two target areas 10 and 11 each take the form of an isosceles trapezoid. The trapezoid for target area 10 includes parallel forward edge 12 and base edge 14 which are connected at their respective ends by equallength sides 16 and 18. The trapezoid for target area 11 is substantially identically configured and includes parallel forward edge 13 and base line 15. Equal sides 17 and 19 join respective edges of forward edge 13 and base line 15. The two target areas are spaced from one another with forward edges 12 and 13 arranged parallel to one another and constituting the most proximate portions of the two target areas.

In the specific example illustrated in FIG. 1, the angle subtended between sides 16 and 18 (and between sides 17 and 19) is forty degrees, the base lines 14 and 15 are each approximately 35 feet long, and the forward edges 12 and 13 are each approximately 6 feet long. Spacing between the two base lines is approximately 120 feet.

It is to be noted that the trapezoidal target areas can be replaced by isosceles triangular areas, as illustrated by the dotted lines in FIG. 1, in which case the apices formed by the two equal sides of each triangle point toward one another. The decision as to whether to employ a trapezoid or a triangle depends upon the degree of difficulty desired for playing the game and is described in detail subsequently. It should also be noted that other shapes may be employed for the target areas; considerations which go into choosing the target area shapes also depend upon the desired degree of difficulty in playing the game.

Figure 2:
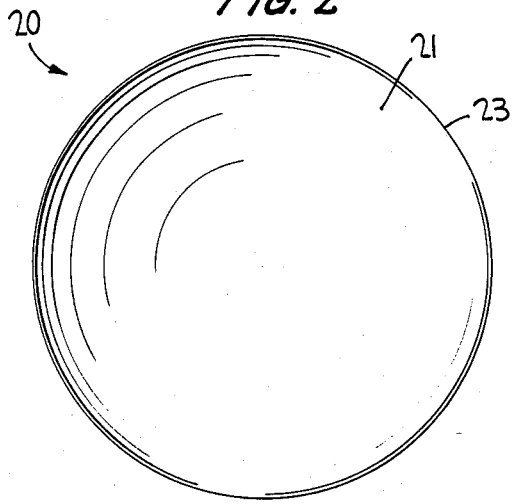
FIG. 2 is a view in plan of the deflecting surface of a shield employed in the game of the present invention.
Figure 3:
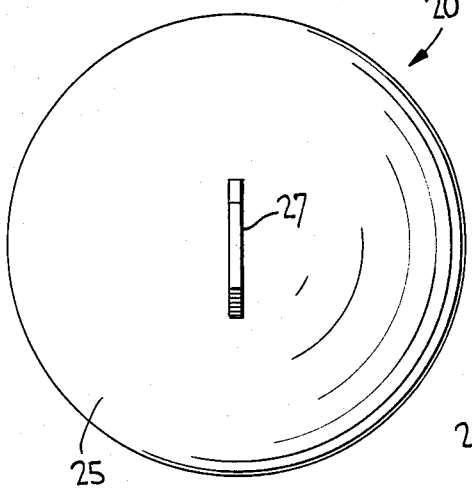
FIG. 3 is a view in plan of the reverse side of the shield of FIG. 2.
Figure 4:
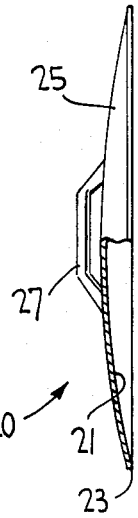
FIG. 4 is an end view in partial section of the shield of FIGS. 2 and 3.

Each player is provided with a shield 20 of the type illustrated in FIGS. 2, 3 and 4 to which specific reference is now made. Shield 20 has a concave obverse surface 21 which serves as the shield deflecting surface. In the preferred embodiment, the deflecting surface is a segment of a sphere and has a circular circumferential rim 23. By way of example, the radius of curvature of such sphere may be approximately 82.5 inches, and the diameter of rim 23 is approximately twenty-four inches. Of course, other shapes, having concave deflecting surfaces, may be employed. The reverse surface 25 of shield 20 may take a variety of configurations and, in the preferred embodiment, is convex to match to concavity of the deflecting surface 21. A handle member 27 is secured to or integrally formed with the reverse surface 25 and permits a player to hold the shield 20 by handle 27 in one hand so that the deflecting surface faces away from the player. Handle 27 must be located to permit the shield to be manipulated with dexterity for the purposes described below. In this regard, the handle 27 may be provided as a projection from rim 23. However, it is found that the greatest maneuverability for purposes of the game of the present invention is achieved when the handle 27 is disposed approximately at the center of the shield.

Figure 5:
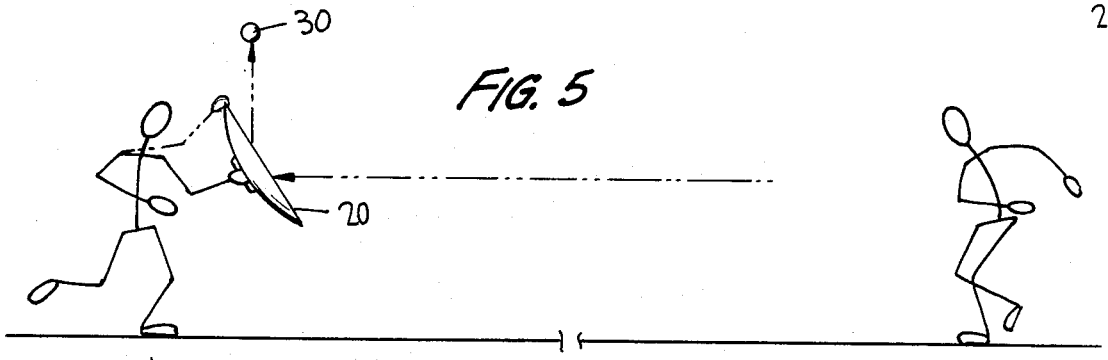
FIGS. 5 and 6 are diagramatic representations of respective sequential steps performed by the players of the game of the present invention.
Figure 6:
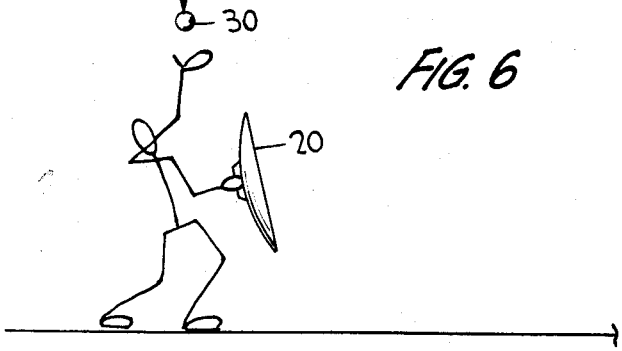

The game of the present invention is played with a projectile, such as a ball 30 of the type illustrated in FIGS. 5 and 6. The object of the invention is for each player to throw the ball 30 into the target area defended by the other player. The defender must deflect the thrown ball with shield 20, in the manner illustrated in FIGS. 5 and 6, so that the defender may catch the deflected ball in his or her bare hand (i.e. the hand not holding handle 27). One or both hands can be used to support the shield during deflection whereby, if two hands are used, one hand grasps the handle and the other serves as a guide or support.

In the preferred form of the game, all throws are made from behind the base lines 14, 15 of the target area which is defended by the thrower, unless the thrower has deflected and caught the other player's throw within his defended target area. Under such circumstances, the catcher/defender is permitted to throw the ball from the spot at which the ball was caught. In this regard, it will be appreciated that the projectile 30 and shield 20 must cooperate in a manner which is consistent with permitting deflection rebounds of the projectile when the projectile forcefully strikes the shield. We have found that an ordinary tennis ball may serve the purpose of projectile 30 and that shield 20 may be made of polyvinylchloride (PVC) which is approximately 0.05 inches thick. Other types of projectiles and shield materials may, of course, be employed within the scope of the invention.

The shape of the target areas 10 and 11 determines the difficulty of the game. For example, if the trapezoidal target areas are employed instead of the triangular target areas, it is more difficult for the thrower to score a goal by throwing the projectile into the forwardmost portion of the target area. In other words, it is easier for a defender to defend the forward area of a target area that is truncated to form a trapezoid than it is to defend the apex area of the triangle. Likewise, the angle formed between the two sides 16, 18 (or 17, 19) of the target area determines how difficult it is for the defender to defend against throws aimed at the rear or base line corners of the target area. We have found that a trapezoid provided with a 40 degree angle between sides 16, 18, a 6 foot length for forward edge 12 and a 35 foot length for base line 14 provides a challenging and yet not impossible target area when the base lines 14 and 15 are spaced by approximately 120 feet. The spacing between the forward edge 12 and base line 14 for such a configuration is approximately 39 feet. Thus, a defender who is able to deflect and catch the ball close to the forward edge 12, 13 of his target area is at a distinct advantage in thereby being permitted to throw the ball at the opposing target area from the closer location.

The degree of difficulty can also be varied by providing an obstruction of some sort at the deflecting surface 21 of shield 20. For example, a cone, an indented portion, or some other non-continuous surface feature may be provided at one or more locations of the deflecting surface 21 to interfere with the predictable rebound angle of the ball from the deflecting surface.

Depending upon the nature of the surface on which the target areas are laid out, it is possible to play the game while permitting the thrower to let the ball strike the ground in advance of the target area defended by his opponent.

Rules for playing the game of the present invention may vary in accordance with the age and dexterity of the players. We have found that the rules described in the following paragraphs provide an interesting and challenging game for teenagers and young adults.

To start the game one of the players serves by throwing the ball at the target area defended by his or her opponent. This throw or serve is made from behind the base line, for example, base line 14. If the ball appears to be headed for the target area 11, the receiver or defender of that target area tries to deflect the ball with his or her shield 20 toward the forward edge 13 of the goal so that he can catch the ball as close as possible to the forwardmost portion of that goal. If the ball is deflected by the shield and caught within the target area or goal, the defender/receiver throws from that spot. If the ball is caught outside the goal, the defender/receiver serves the next point from behind the base line 15. If the thrown ball lands within the goal, either because the defender failed to deflect the thrown ball or failed to catch the deflected ball, the thrower scores a point and defender serves the next point from behind the base line. If the original serve is outside the goal, the defender also serves from behind the base line. In one variation of the playing rules, a player who deflects and catches the ball within his defended target area may be provided with two throwing opportunities at the opponent's goal if the first throw is bad. This rewards the defender/returner for having deflected and caught the opponent's throw within the defended target area.

In one form of scoring, each player may be given a point for each throw landing in the target area defended by his or her opponent and for each successful defense in which the opponent's throw is deflected and caught within the goal. In addition, successive scoring by one player may be weighted so that the second score of two successive scores by one player may be worth two points, the third successive score may be worth four points, etc. Alternatively, successive scores may be weighted the same as the initial score or each successive score may be weighted as two points. The number of points required to win a game may be seven, eleven, fifteen, or any number desired.

Points may also be scored, in one form of the game, by a defender when the thrower fails to throw the ball into the target area defended by that defender, even though the defender did not deflect and catch the ball. In other words, a server would lose a point if he fails to throw the ball into the target area defended by his opponent. Likewise, a returner might lose a point for failure to throw the ball into the server's target area; however, it is desirable to permit a returner two throws in order to reward the returner for having deflected and caught the serve.

It will be appreciated that a wide variety of rules and scoring schemes may be employed within the scope of the present invention.

Figure 7:
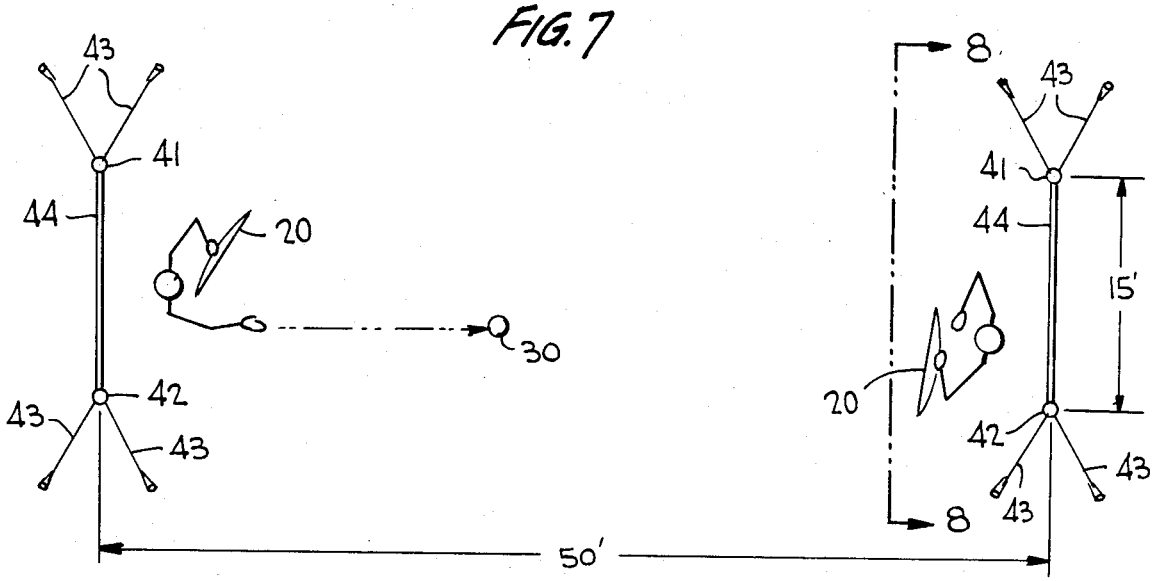
FIG. 7 is a diagramatic view in plan of a playing area of the game of the present invention employing vertical goals.
Figure 8:
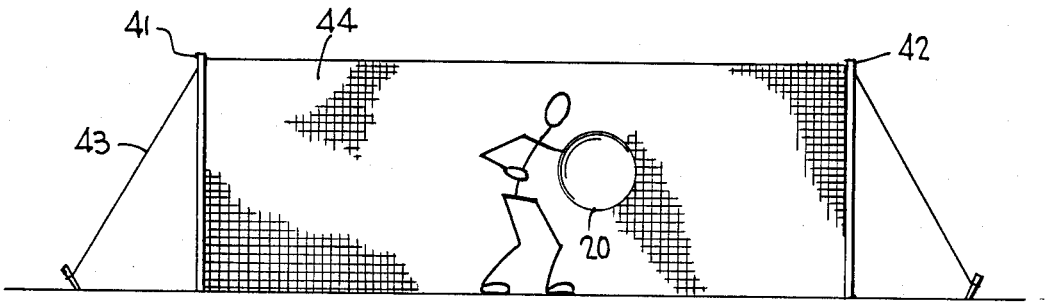
FIG. 8 is a diagramatic view in elevation of one of the goals employed in the embodiment of FIG. 7.

The game may also be played with a target area which is substantially vertical and comprises a frame, in front of which the defender stands to prevent the thrown ball from entering the frame. An example of a vertical target area is illustrated in FIGS. 7 and 8. Specifically, each goal includes a pair of spaced vertical poles 41 and 42 which are supported by guy wires 43, or the like. A net 44 is stretched between the poles 41, 42 in a vertical plane to provide a target area between the poles. The poles 41, 42 and the top of the net 44 define a vertical frame target area. Each player must defend the vertical target area in a similar manner to that described above with relation to the horizontal target area in the embodiment of FIG. 1. The spacing between the poles is adjustable; typically, the vertical goals are spaced 50 feet apart and are 15 feet wide and 6 feet high. These dimensions are by way of example only and, of course, are not intended to be limiting upon the scope of the present invention. The defending player must defend by deflecting the ball thrown by his opponent in a manner which permits the defender to catch the deflected ball in his or her free hand. Preferably, an area is marked off in front of each goal within which the defender tries to catch the deflected throw so as to be permitted to throw the ball back at the opponent's goal from within that marked off area. Otherwise, the defender must make the next throw from behind a suitable line which would also be marked in front of or alongside the goal which is being defended by the thrower.

The game as described hereinabove is designed expressly for two players. It should be noted, however, that the principles of the present invention apply to three players or more, each defending his or her own target area. For example, if three target areas are provided, they would be placed at mutually equally spaced locations. Under such circumstances, the advantageous target area configuration provided by the trapezoid and triangle is lost, for purposes of the present game, and the target areas might best be provided in circular form. If more than three players and target areas are involved, not every target area can be positioned equally distant from all of the others. The rules, under such circumstances, may be revised to prevent players from throwing at the immediately adjacent target areas or for structuring the scoring system so that more points are obtained for scoring in a remote target area then in an adjacent target area. It is possible to play the game in teams with two or more players per team and with each team defending a respective goal or target area.

A desirable feature of the present invention is to provide adjustable areas for the goals or target areas. This permits the game to be adjusted to the level of competence of different players.

While we have described and illustrated specific embodiments of our invention, it will be clear that variations from the details of construction which are specifically illustrated and described may be resorted to without departing from the true spirit and scope of the invention as defined in the appended claims.

We claim:

1. A game for a plurality of players comprising:

a plurality of shield members, one for each player, each shield member including rebound means for providing substantial and controllable generally upward rebound of airborne objects under the control of a player, said rebound means including a concave rebound surface and handle means arranged to permit a player to movably support the shield member in one hand with said concave rebound surface facing away from that player, said rebound surface having a sufficiently moderate degree of concavity to permit said substantial and controllable rebound; and projectile means:responsive to being forcefully impacted against said concave rebound surface of a shield member for resiliently bouncing from that rebound surface;

whereby the object of the game is for one player to hurl said projectile toward another player and for said another player to rebound the projectile with the concave rebound surface of one of said shield members and catch the rebounded projectile before it lands.

2. The game according to claim 1 wherein said handle means is disposed on a rearward side of said shield member, which rearward side faces in an opposite direction from the rebound surface.

3. The game according to claim 2 wherein said rebound surface is a segment of a sphere.

4. The game according to claim 3 wherein the radius of curvature of said sphere is approximately 82.5 inches and wherein said rebound surface has a circular rim with a diameter of approximately 24 inches.

5. The game according to claim 1 further comprising means for demarking a target area.

6. The game according to claim 5 wherein said target area is substantially vertical and comprises a frame in front of which said another player stands to prevent said projectile from entering said frame.

7. The game according to claim 6 wherein said frame is approximately 4 yards wide and 2 yards high.

8. The game according to claim 7 wherein said frame has at least one adjustable dimension.

9. The game according to claim 1 wherein said projectile is a ball.

10. A game comprising:

a plurality of shield members, each including a deflecting surface and handle means arranged to permit a player to movably support the shield member in one hand with said deflecting surface facing away from that player;

projectile means responsive to being forcefully impacted against said deflecting surface of a shield member for resiliently bouncing from that deflecting surface;

whereby the object of the game is for one player to hurl said projectile toward a prescribed target area and for another player to prevent the projectile from striking the targe area by deflecting the projectile with the deflecting surface of one of said shield members and to permit catching of the deflected projectile ore it lands; and wherein said target area is a generally triangular horizontally-disposed area having a base line and an opposed apex, and wherein said game is played by said another player standing inside said generally triangular area and by said one player standing at a location considerably spaced from said generally triangular area but closer to said apex than to said base line.

11. The game according to claim 10 wherein said generally triangular area is isosceles, said base line being a third side between two substantially equal sides.

12. A game comprising:

a plurality of shield members, each including a deflecting surface and handle means arranged to permit a player to movably support the shield member in one hand with said deflecting surface facing away from that player;

projectile means responsive to being forcefully impacted against said deflecting surface of a shield member for resiliently bouncing from that ddflecting surface;

whereby the object of the game is for one player to hurl said projectile toward a prescribed target area and for another player to prevent the projectile from striking the target area by deflecting the projectile with the deflecting surface of one of said shield members and to permit catching of the deflected projectile before it lands; and means for demarking said target area;

wherein said target area is a generally isosceles trapezoid having short and long parallel sides with said short side most proximate said one player.

13. The game according to claim 12 wherein said short side is approximately 6 feet long and said long side is approximately 35 feet long.

14. The game according to claim 12 further comprising a playing area in which two of said substantially isosceles trapezoidal target areas are disposed with the short sides of the trapezoids facing one another and spaced by at least 25 feet.

15. The method of playing a game between at least first and second players in a playing area having first and second spaced target areas, said method comprising the steps of:

said first player standing remote from said second target area and attempting to hurl a resilient projectile into said second target area while said second player defends said second target area by attempting to cause the hurled projectile to rebound with a generally upward trajectory from a shield held in one hand and catch the rebounded projectile in the other haand before the projectile falls to the ground;

said second player attempting to hurl said proj3ctile, from a location dependent upon where and if the rebounded projectile was caught, into said first target area while the first player defends said first target area by attempting to rebound the projectile generally upward with a shield held in a first hand and catch the rebounded projectile in a second hand before the projectile falls to the ground; and said first and second players continuing in alternation to attempt to hurl the projectile into said second and first target areas, respectively, while said second and first players, respectively, attempt to rebound and catch said projectile.

16. The method according to claim 15 wherein said target area is horizontally-disposed on the ground and wherein each player must hurl the projectile from behind the target area defended by that player unless that player rebounds the hurled projectile with a shield and catches a rebounded projectile while within the defended target area, in which case that player hurls the projectile from the spot at which the rebounded projectle is caught.

17. A shield for use in deflecting a hurled projectile so that it may be caught before it falls to the ground, said shield comprising:

means for providing substantial and controllable generally upward rebound of the hurled projectile under the control of a player, said means including a generally concave rebound surface;

handle means for movably supporting the shield in one hand of the user with said rebound surface facing away from the user;

wherein said shield is made of a material which is sufficiently rigid to retain a generally moderately concave shape of said rebound surface necessary to provide said controllable and substantial rebound but sufficiently resilient to permit said projectile to bounce off said rebound surface when a projectile forcefully strikes said rebound surface.

18. The shield according to claim 17 wherein said handle means is disposed on a rearward side of said shield member, which rearward side faces in an opposite direction from the rebound surface.

19. The shield according to claim 18 wherein said rebound surface is a segment of a sphere and wherein said handle means is substantially centered on said rearward side of said shield.

* * * * *